US005902188A

United States Patent [19]

Meniconi

[11] Patent Number: 5,902,188

[45] Date of Patent: May 11, 1999

[54] PHOTOELECTRIC PINFALL DETECTION SYSTEM

[75] Inventor: Vittorio Meniconi, Oberdürnten, Switzerland

[73] Assignee: BMS Bowling Marketing Services AG, Ruti, Switzerland

[21] Appl. No.: 08/839,270

[22] Filed: Apr. 17, 1997

[30] Foreign Application Priority Data

Jun. 26, 1996 [CH] Switzerland ..... 1605/96

[51] Int. Cl.[6] ..... A63D 5/04

[52] U.S. Cl. ..... 473/101; 473/65; 473/69

[58] Field of Search ..... 473/57, 65, 67, 473/69, 70, 71, 101

[56] References Cited

U.S. PATENT DOCUMENTS 3,847,394 11/1974 Logemann et al. ..... 473/101
4,726,587 2/1988 Fitch ..... 473/101
4,827,412 5/1989 Form ..... 473/101
5,649,869 7/1997 Infantino et al. ..... 473/118
5,683,080 11/1997 Vaioli et al. ..... 473/101

*Primary Examiner*—William M. Pierce
*Attorney, Agent, or Firm*—Tarolli, Sundheim, Covell, Tummino & Szabo

[57] ABSTRACT

A bowling alley is provided with a photoelectric pinfall detection system which includes a pinfall detection device by means of which it can be recognized whether or not a fallen pin is lying in the end region of the bowling lane or in one of the gutters. The pinfall detection device comprises a light sensitive sensor array which detects any radiation reflected by a pin lying in the end region of the bowling lane. For this purpose, the lower foot portion of each pin may be provided with a black ring. Thus, the reflection characteristics of the pin change in dependence whether the pin is standing upright or has fallen, because in the first case the weak reflection of the black ring is detected by the pinfall detection apparatus, while in the second case the strong reflection of the white central portion of the pin is detected.

19 Claims, 8 Drawing Sheets

PHOTOELECTRIC PINFALL DETECTION SYSTEM

FIELD OF THE INVENTION

The present invention relates, according to a first aspect, to a photoelectric pinfall detection system to be used in a bowling alley having at least one bowling lane, the pins being arranged in an end region thereof, and having gutters extending along both sides of each bowling lane, whereby the gutters are downwardly offset in height as compared to the surface of the bowling lane. According to a second aspect, the-present invention also relates to a method for optimizing the sequences of movement of the pin handling means of a bowling alley, and according to a third aspect to a pin to be used in the above mentioned pinfall detection system.

In a bowling alley, ten pins are placed in the end region of a pin deck in a predetermined arrangement In order to place the pins on the pin deck, nowadays usually automatically operating pin setting machines, so-called pinsetters, are in use which arrange the pins without the need of an operator. The pin handling assemblies of a bowling alley comprise a plurality of individual devices and apparatuses cooperating with each other, whereby in the following only those devices and apparatuses essential in connection with the present invention will be considered. To be mentioned in this connection are a combined barrier and wiper member, a light barrier device located in front of the pin setting area, a belt conveyor located behind the end of the pin deck, as well as pinsetter for grasping and lifting pins off the pin deck and for subsequently placing them thereon.

It is assumed that any person interested in the present invention is familiar with the essential parts and elements of a bowling alley as well as with the rules of the bowling game. Having this background in mind, in the following, the usual course of a bowling game shall be described in a very simplified form. Thereby, in the first of the following examples, it is assumed that at least one, but not all pins have been hit by the first throw of a ball.

As soon as the first ball has passed the light barrier, the combined barrier and wiper member is lowered onto the pin deck in an end region thereof and in front of the still upright standing pins. By this lowering operation, it is avoided that pins roll away from the pin setting area onto the pin deck. After a certain delay, defined according the rules to be approximately 3 seconds, a scorer detects the number of fallen pins and shows the result in a display. The still standing pins are engaged by the pinsetter and lifted off the pin deck. Usually, the pin setter is provided with a number of grippers and mechanically operated switches, which number corresponds to the number of pins, to scan which pin has fallen and which pin is standing upright. Therefore, this operation is also called scan cycle.

After this scan cycle, the combined barrier and wiper member is operated to perform a forward movement under the pinsetter and the lifted off pins towards the end of the pin deck to displace any pin lying on the pin deck and/or in the gutters to the end of the pin deck, where they are received by the running belt conveyor and transported therewith away from the region of the pin deck to be re-introduced into the circulation path within the machine. Thereafter, the barrier and wiper member moves back and the pins gripped by the pinsetter are placed back into their original positions on the pin deck, where they were placed before. In other words, a pin which has been displaced by a ball, but which has not fallen, must be placed back to its displaced position again by the pinsetter. Thus, that operation of the pinsetter is called set cycle. Now, the combined barrier and wiper member is lifted into its initial retracted position and the bowling lane is opened for the next throw.

One of the problems frequently involved during that set cycle may be seen in the fact that a displaced, but still standing pin can block the pinsetter if it has been displaced by such an amount that it is outside the gripping region of the pinsetter. The pinsetter, being in its downward movement, abuts against the displaced standing pin and the entire sequence of operation is blocked. In such a case, only manual involvement can help, e.g. an operator must remove or displace that particular pin.

If all pins are hit by the first ball and fall, the procedure changes insofar as no standing pins can be nor have to be gripped by the pinsetter and lifted off the pin deck. The remaining operation cycles of the pin handling assembly remain the same, i.e. the combined barrier and wiper member is lowered and displaced forth and back. However, in place of the still standing pins, a new set of pins is set up on the pin deck.

Also in the other extreme case, i.e. when no pins have been hit neither by the first nor by the second ball, the pin handling assembly unnecessarily performs at least some of the above mentioned operation cycles.

Finally, it frequently happens that all pins hit by the first ball do not remain lying in the end region of the bowling lane, but are displaced away under the influence of the kinetic energy transformed from the moving ball to the pins to such an extent that they fall onto the running belt conveyor and are transported out of the region of the bowling lane. In such a case, i.e. no pins lying on the pin deck in the end region thereof, it would be possible to continue the game with the second throw without the need to perform a wiping operation nor an operation of the pinsetter.

It is obvious from the above explanations that the pin handling assembly usually performs a lot of unnecessary operations in the course of a plurality of ball throws, in practice even after most of the ball throws. The result is that the pin handling assembly is subjected to wear in a high degree and, thus, is often in need of repair, and that the game is unwantedly delayed. In order to limit the expenditure in servicing a bowling alley, it would be desirable to limit the number of operations of the pin handling assembly to an absolutely required minimum and to avoid every unnecessary operation of the quite complicated pinsetter and wiper mechanism.

OBJECTS OF THE INVENTION

It is therefore an object of the invention to provide a photoelectric pinfall detection system, which can be used to avoid unnecessary operations of the pin handling assembly and to optimize the operation of the pin handling assembly, respectively.

It is a further object of the invention to provide a method for optimizing the sequences of movement of the pin handling assembly of a bowling alley such that unnecessary operations of the pin handling assembly are avoided.

It is a still further object of the invention to provide a pin to be used in a photoelectric pinfall detection system of the kind referred to.

SUMMARY OF THE INVENTION

To meet these and other objects, the present invention provides, according to a first aspect and based on the consideration that the second ball can be thrown whenever no pin is lying in the end region of the bowling lane, a photoelectric pinfall detection system to be used in a bowling alley having at least one bowling lane, the pins being arranged in an end region thereof. The bowling alley has gutters extending along both sides of each bowling lane. The gutters are downwardly offset in height as compared to the surface of the bowling lane. The pinfall detection system comprises at least one pinfall detection device adapted to recognize whether or not at least one fallen pin is lying in the end region of the bowling lane or in one of the gutters.

By means of the use of such a pinfall detection system, unnecessary operating cycles of the pin handling assembly can be avoided, because in all those cases in which there isn't any fallen pin lying in the end region of the bowling lane, it is possible to do it at least without the operation of the combined barrier and wiper member. Moreover, depending on the particular case (first/second throw; no pin hit/all pins fallen), the subsequent sequence or movement of the pinsetter can be optimized by deciding which operations are required and which operations can be avoided.

For example, in the case that no pin has been hit by the first ball, the bowling lane can be opened for the next throw immediately after the prescribed delay time, without the need to wait for the completion of an unnecessary wiping and/or pinsetting operation. Also in the case that any number of pins between one and nine have been hit by the first ball and all fallen pins are lying outside the end region of the bowling lane, neither the wiping operation nor the set cycle have to be performed.

Moreover, even if all ten pins have been hit by the first throw and lie outside the end region of the bowling lane, at least the wiping operation can be avoided. Finally, by means of the pinfall detection system of the invention, a blocking of the pinsetter can be avoided if, after the first ball, no fallen pin is present in the end region of the bowling lane and, simultaneously, a pin has been displaced to such an extent that it cannot be gripped by the pinsetter anymore.

In a preferred embodiment of the pinfall detection system according to the invention, the pinfall detection device comprises at least two sensor assemblies, which are adapted to detect the light reflected by the pins. One of the sensor assemblies serves for detecting the presence of an upper portion of a standing pin, while a second sensor assembly serves for detecting the presence of a lower portion of a standing pin as well as the presence of a lying pin. Both sensor assemblies supply an output signal in response to the detection result. If one of the output signals is subtracted from the other one, the pinfall detection system can be neutralized in the regions where a pin is standing, because the output signals eliminate each other. On the other hand, the output signals generated in response to the detection of a lying pin are not affected by this subtraction; thus, on the basis of the resulting final output signal, it can be easily and quickly recognized whether or not fallen pins are lying in the end region of the bowling lane.

According to a further aspect of the invention, a method is provided for optimizing the sequences of movement of the pin handling means of a bowling alley. Particularly, in this method, first each throw of a ball is detected and recorded. Then it is recognized whether or not at least one fallen pin is lying in the end region of the bowling lane or in one of the gutters extending along both sides of said bowling lane. Finally, considering whether the last detected throw was the first or second throw of a ball, it is decided, in dependence of that consideration and in dependence whether or not a fallen pin has been recognized, what sequences of movement have to be executed by said pin handling means and what sequences of movement are to be avoided.

Finally, according to a third aspect of the invention, a pin is provided which can be used in such a pinfall detection system. The pin comprises an upper head portion, a bulbous central portion and a lower foot portion. The lower foot portion has a smaller diameter than the bulbous central portion. Thus, the lower portion is lifted off the surface of the bowling lane when the pin is lying on its surface. Moreover, each pin comprises an annular preferably black strip located in the lower portion.

This means that, in the case of a lying pin, not the black strip is in a position closely above the surface of the pin deck, but the central portion of the pin which has a contrasting color, usually white. Thus, reflected radiation received by the pinfall detection apparatus is different, depending whether it "sees" a standing or a fallen pin, under the presupposition that the pinfall detection system comprises a scanning region including only a narrow slice located closely above the surface of the pin deck and if only such a scanning region is processed, respectively.

For this reason, a preferred embodiment of the pinfall detection system comprises a light sensitive sensor assembly which is aligned in vertical and angular directions such that the black annular strip located in the lower portion of the pins is projected onto the sensor assembly when a pin is in its upright standing position.

BRIEF DESCRIPTION OF THE DRAWINGS

In the following, embodiments of the invention will be further described, with reference to the accompanying drawings, in which.

DETAILED DESCRIPTION OF PREFERRED EMBODIMENTS

Figure 1:
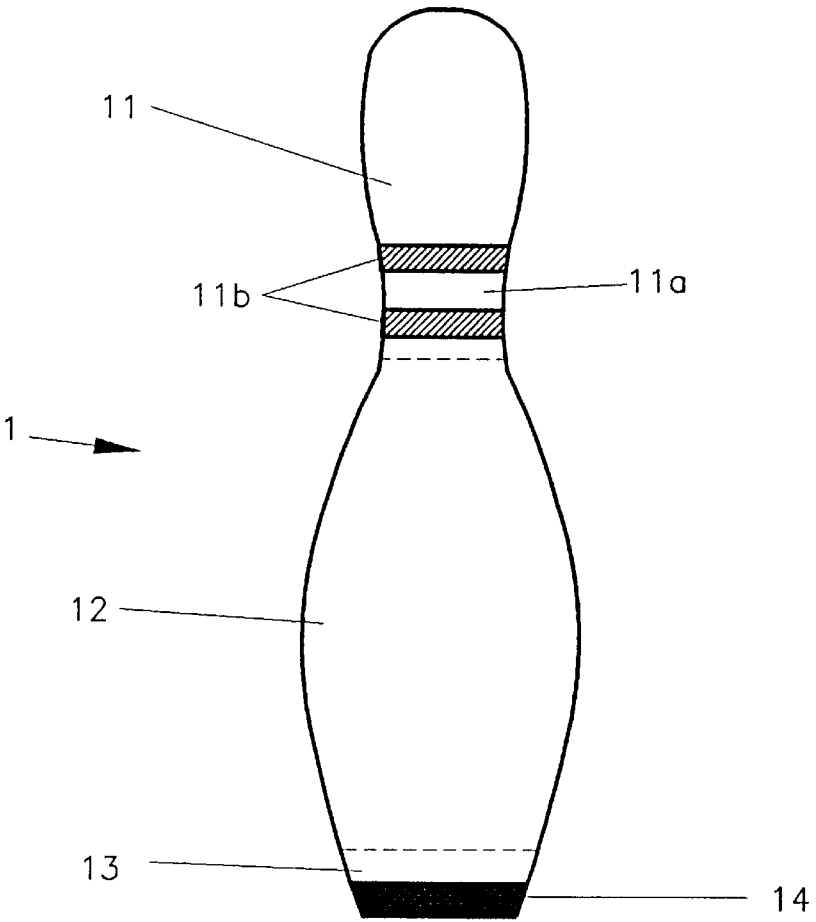
FIG. 1 shows a side view of a pin.

FIG. 1 shows a pin 1 in a side elevational view. Such a pin as shown in FIG. 1 represents more or less the today's standard shape of a bowling pin. As seen in vertical direction, such a pin 1 can be separated roughly into three sections: (1) An upper head portion 11; (2) a central portion 12; and (3) a lower foot portion 13. While the head portion 11 has a generally elongate shape and the central portion 12 a generally bulbous shape, the foot portion 13 tapers towards the pin base such that it has a smaller diameter than the central portion 12.

In the region of the neck 11*a* of the head portion 11, the pin 1 is provided, as usual, with two rings 11*b* having a different color than the pin 1 itself.

According to a preferred embodiment of the invention, the pin 1 is provided with a ring 14 located close to the lower end of the foot portion 13; preferably, the ring 14 is black such that it shows a strong contrast to the base color of the pin 1, which is usually white. The meaning and function of this ring 14 will be further explained herein after.

Figure 2:
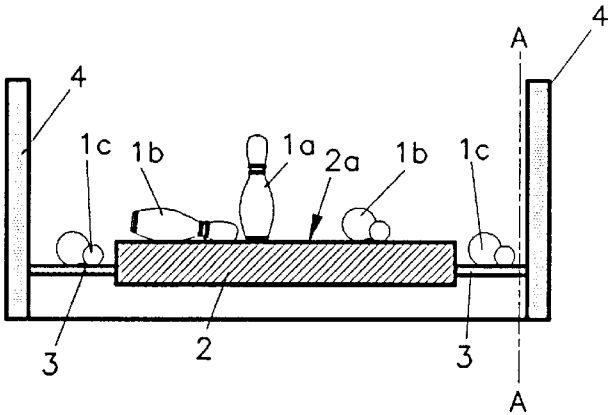
FIG. 2 shows a cross sectional view of a bowling lane in the region of the end of the pin deck.

FIG. 2 shows a streamlined cross sectional view of a bowling lane in the region of the end of the pin decks. In the center of the bowling lane, the real pin deck 2 is located, on whose surface 2*a* the pins 1*a* are set up. Along both sides of the pin deck 2, gutters 3 are provided, the surface of which is at a somewhat lower level than the surface 2*a* of the pin deck. As is well known, these gutters 3 serve for receiving and guiding bowling balls which have left the pin deck 2 either in left side or in right side direction. Each of the two gutters 3 is delimited at its outer side in each case by a wall member 4.

Figure 3:
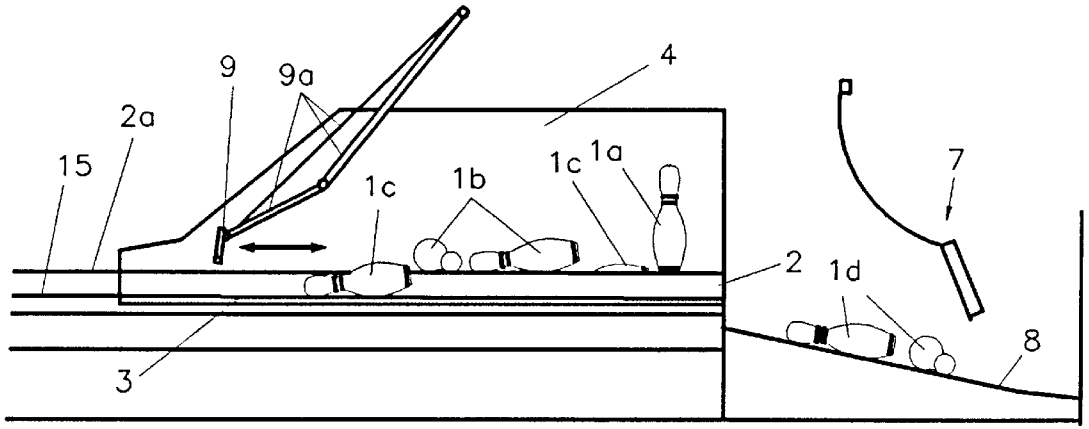
FIG. 3 shows a longitudinal sectional view of a bowling lane in the region of the end of the pin deck.

FIG. 3 shows a longitudinal sectional view of the end region of the bowling lane, taken along the line A—A in FIG. 2. This figure shows, in addition to the pin deck 2, the one side wall 4 and the one gutter 3, a wiper member 9, a belt conveyor assembly 8 located behind the pin deck 2 and a ball curtain assembly 7. The wiper member 9 is suspended by means of a linkage assembly 9*a* in such a way that it can be not only raised from and lowered towards the pin deck 2, but also can be displaced forth and back in the direction of the extension of the bowling lane. In the situation schematically shown in FIG. 3, the wiper member 9 is lowered close to the surface 2*a* of the pin deck 2 at a predetermined place in front of the end of the pin deck 2; thus, it has the effect of a barrier to hinder the fallen pins 1*b*, 1*c* to roll back on the pin deck, i.e. towards the left, as seen in FIG. 3. Moreover, the wiper member 9, being in its lowered position, is adapted to be moved from the left to the right, as seen in FIG. 3, along the pin deck 2. By this displacement from the left to the right, the fallen pins 1*b*, 1*c* are wiped off the pin deck 2 and the gutter 3 and displaced onto the running belt conveyor 8 which conveys the pins 1*d* located on its surface away to a (not shown) pin transportation assembly.

As a result of the operation of the wiper member 9, not only the fallen pins 1*b* lying on the surface 2*a* of the pin deck 2, but also the fallen pins 1*c* lying in the left and right sided gutters 3 are moved backwards off the pin deck 2 onto the belt conveyor 8. For this purpose, the wiper member 9 is equipped with suitably shaped end portions having a larger width, not visible in FIG. 3, which project into the gutters 3 to reliably engage the pins 1*c* lying therein.

The pins 1*d* wiped off the pin deck 2 and transported to the previously mentioned transportation assembly are conveyed by the latter one to a (not shown) pin setter located above the pin deck 2. As is well known to any person skilled in the art, the pins 1*a* which remain standing after the first ball throw are lifted off the pin deck by means of the pin setter; then the wiper member 9 is operated to remove the pins 1*b*, 1*c* lying on the pin deck 2 and/or in the gutters 3, and the pins 1*a* previously lifted off the pin deck 2 are set thereon again. Moreover, the pin setter is responsible for setting a new set of pins 1 on the pin deck 2 after the second ball throw. The ball curtain 7 located behind the pin deck 2 and above the belt conveyor 8 serves for catching and deflecting the balls and pins which may overrun the end of the bowling lane and usually arriving at high speed.

Figure 4:
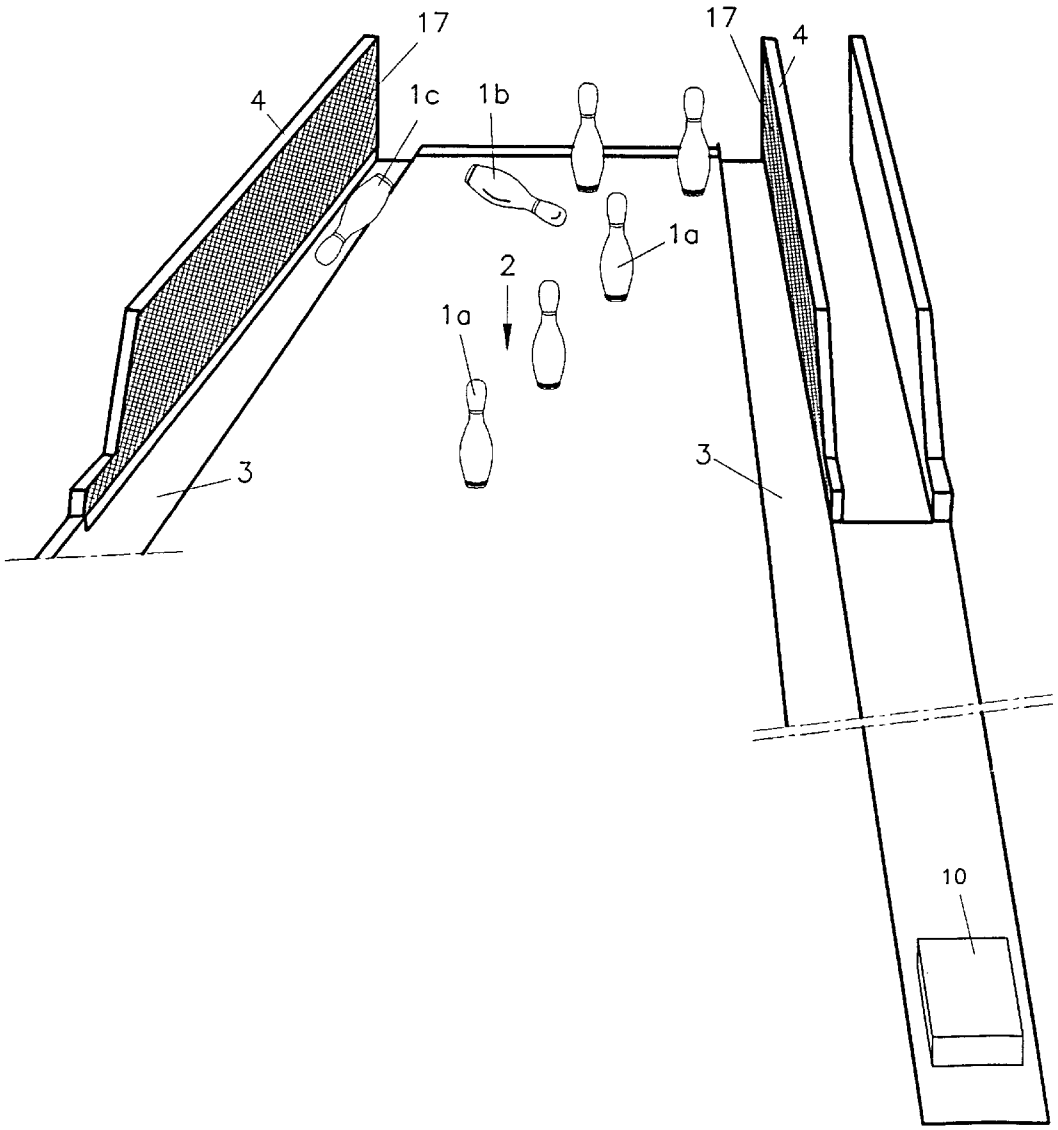
FIG. 4 shows a perspective partial view of a bowling lane in the region of the end of the pin deck.

FIG. 4 shows a perspective partial view of the bowling lane in the region of the end of the pin deck 2. In this drawing, a possible arrangement of the pins 1*a*, 1*b*, 1*c* on the pin deck 2 and in the gutters 3 is shown after the first ball throw. Particularly, it can be seen from FIG. 4 that five pins 1*a* are still standing and four pins have fallen; one pin 1*b* lies on the pin deck 2, another pin 1*c* has arrived in the left sided gutter 3 and two further pins may have thrown away from the pin deck 2, e.g. onto the belt conveyor 8, not visible in FIG. 4. Further, it can be seen from that drawing that the two side walls 4 are preferably provided with a dark painting 17 such that the usually white pins 1*a*, 1*b*, 1*c* present a good contrast to the dark walls 4.

The apparatus for detecting the presence of fallen pins 1*b*, 1*c* is also schematically shown in FIG. 4 and designated by reference numeral 10. It should be noted that the apparatus 10 is located in a laterally offset relationship to the bowling lane and in a certain distance from the end of the pin deck 2.

Figure 5:
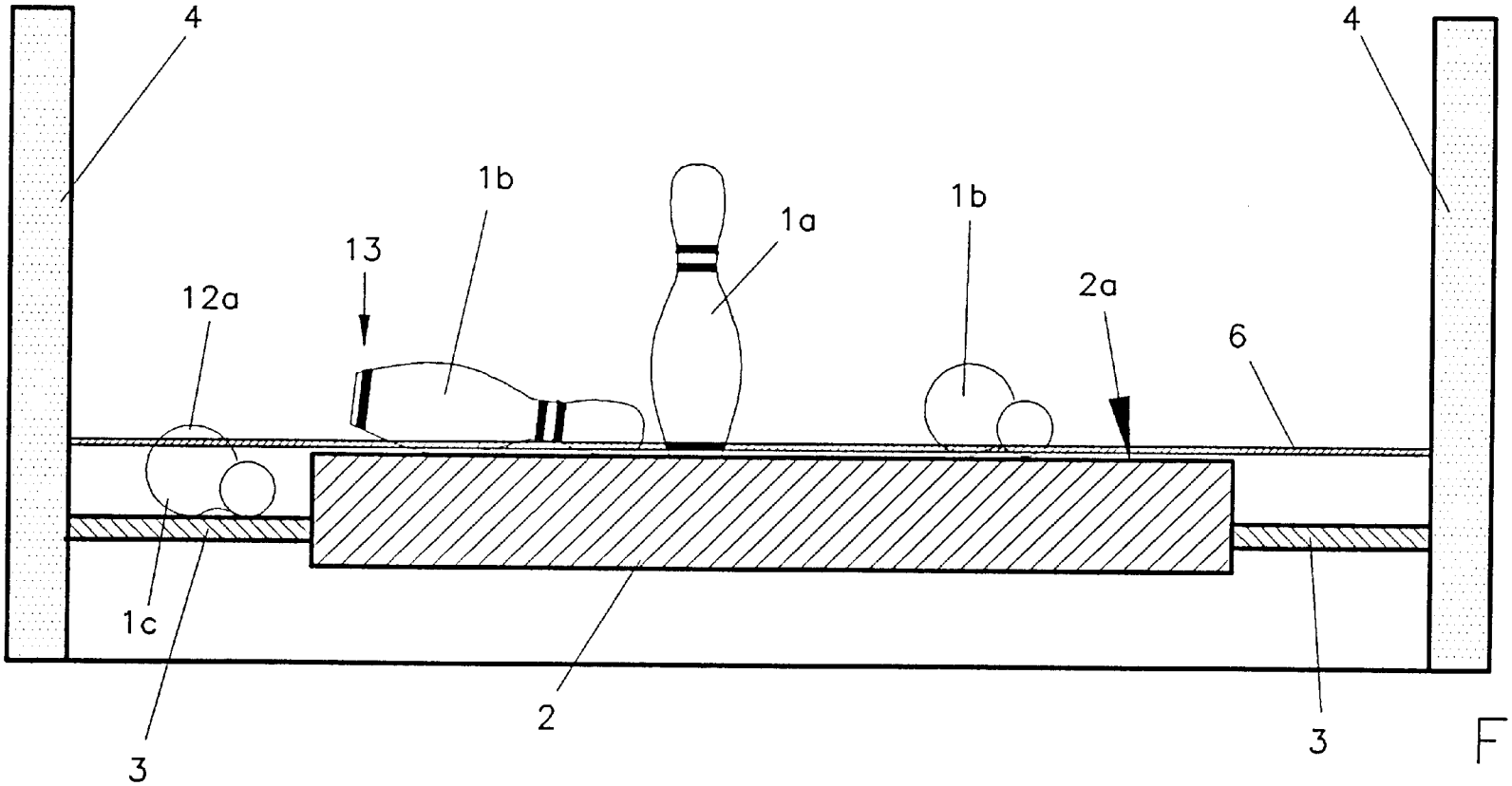
FIG. 5 shows a cross sectional view similar to the one shown in FIG. 2, but in a larger scale.
Figure 6:
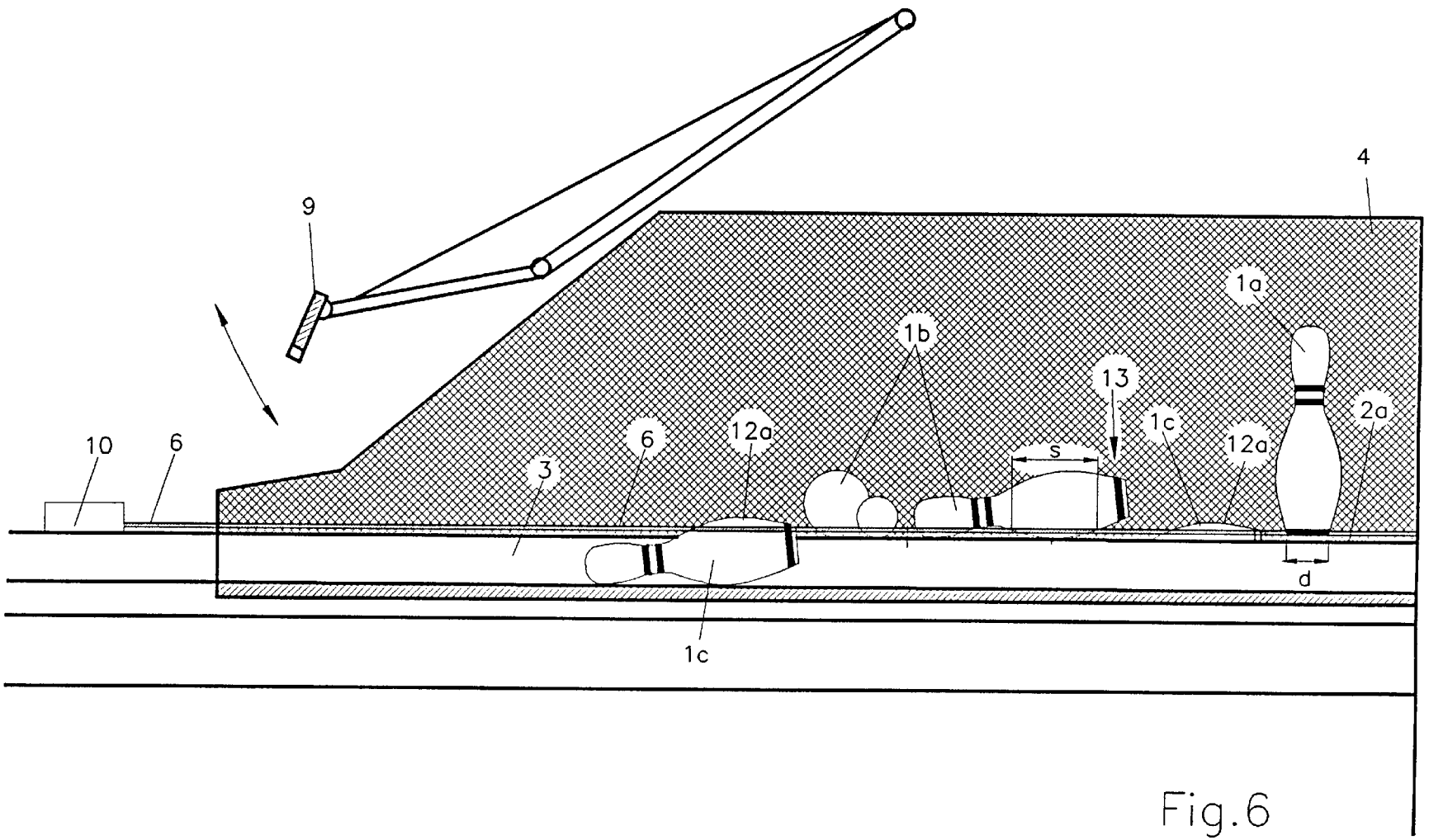
FIG. 6 shows an enlarged window of FIG. 3.

FIG. 5 shows a cross sectional view similar to the one shown in FIG. 2, but in a larger scale, and FIG. 6 shows an enlarged window of FIG. 3, taken in the end region of the pin deck 2. Again, the pinfall detection apparatus 10 is schematically shown in FIG. 6. In these two figures, it can be clearly seen that the foot portion 13 of a fallen pin 1*b* is lifted off the surface 2*a* of the pin deck 2. Moreover, it is evident that the offset in height of the gutter 3, as compared to the surface 2*a* of the pin deck 2, is less than the greatest diameter of a pin 1, with the result that the bulbous center portion 12*a* of a pin 1*c* lying in the gutter 3 towers above the surface 2*a* of the pin deck 2.

If in the following, in connection with fallen pins, the expression "end region of the pin deck" is used, one should understood thereby not only the pin deck 2 itself, but also the two end regions of the gutters 3 running parallel to the pin deck 2.

The hatched plane 6 shown in FIGS. 5 and 6 shall symbolize that region in the space that is scanned by a sensor array provided in the pinfall detection apparatus 10. Within this region 6, the pinfall detection apparatus 10 can recognize the differences between light and dark which are to be further processed, as will be explained herein after.

Figure 7:
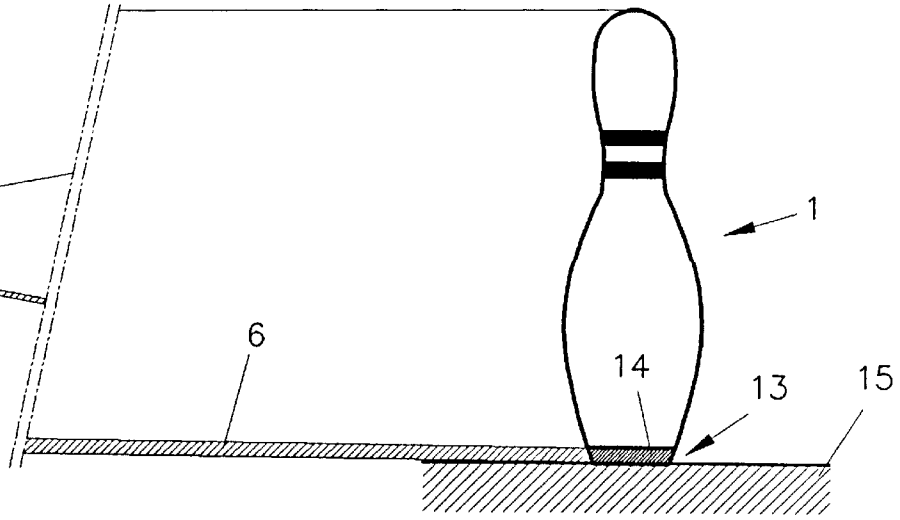
FIG. 7 shows a diagrammatic view of a pinfall detection apparatus incorporating an optical system.
Figure 8:
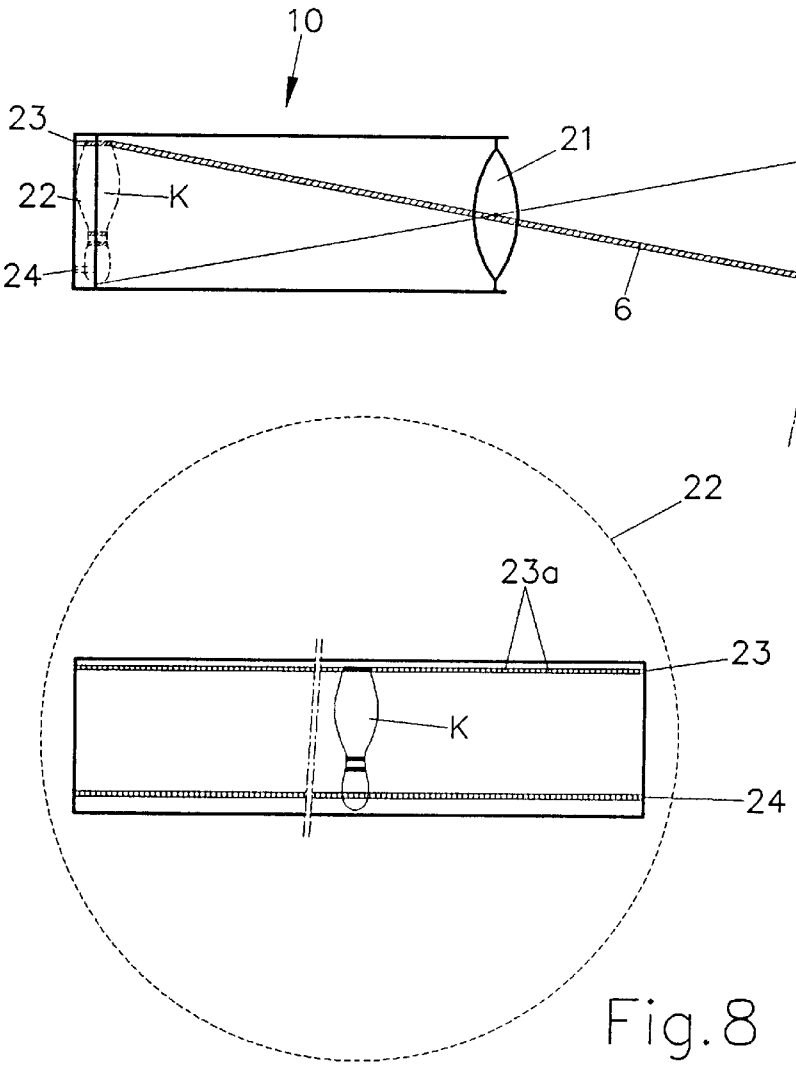
FIG. 8 shows the sensor assembly of the pinfall detection apparatus of FIG. 7 in a front view.

FIG. 7 shows a diagrammatic view of the pinfall detection apparatus 10 incorporating an optical system, and FIG. 8 shows the sensor assembly of the pinfall detection apparatus of FIG. 7 in a front view.

The pinfall detection apparatus 10 is provided with an array 23 of photo diodes 23*a* serving as the sensor elements of the pinfall detection system. In front of the sensor array 23, there is provided an optical system 21. Such photo diode arrays are commercially available nowadays in the form of integrated circuits and usually comprise a number of $2^n$ of individual photo diodes 23*a*, for example a number of 1028 photo diodes 23*a*, which are arranged in a row close to each other. By means of the optical system 21 located in front of the photo diode array 23, a picture of the end region of the pin deck is projected onto a circular plane 22 in the interior of the pinfall detection apparatus 10. In order to render the function of the pinfall detection system 10 even more clear, FIG. 7 shows a pin 1 standing on the pin deck 2, the picture K of the pin 1 being projected onto the circular detection surface 22 by means of the optical system 21.

Within the circular detection surface 22, the sensor array 23 is arranged in horizontal alignment and in such a vertical height that in each case the lower foot portion 13 of a standing pin 1 is projected onto the row of photodiodes 23*a*. The section scanned by the sensor array 23, again, is designated by reference numeral 6 in FIG. 7. In the case of a standing pin 1, in each case only its black ring 14 is optically recognizable for the sensor array 23, because this ring 14 is located in vertical direction within the section 6 scanned by the pinfall detection apparatus 10, projected onto the photo diode array 23 and extending slightly over the surface 2*a* of the pin deck 2. Because a black surface substantially doesn't reflect any light, as is well known, a standing pin 1 substantially doesn't reflect light which could be recognized by the sensor array 23.

As can be further seen particularly in FIG. 8, a second sensor array 24 can be provided to scan the upper portions of the pins 1 and to recognize whether or not a standing pin is present. Thus, a pinfall detection apparatus 10 comprising two arrays 23 and 24 of sensors, both running horizontally and parallel to each other in spaced relationship, is suitable not only for the detection of the presence of fallen pins 1*b*, 1*c*, but also for the detection of the game results.

If several pins 1*b* have fallen and lie on the pin deck 2, as shown in FIGS. 5 and 6, the fallen pins 1*b* engage the surface 2*a* of the pin deck 2 by their white bulbous center portion 12*a* and their white head portion 11. Thus, in the case of a fallen pin 1*b*, a part of the white bulbous center portion 12*a* and/or a part of the also white head portion 11 comes to lie into the hatched plane 6, i.e. into the section of space which is scanned by the pinfall detection apparatus 10, because the foot portion 13 and, therewith, the black ring 14 is lifted off the surface 2*a* of the pin deck 2. Similarly in the case of a pin 1*c* lying in the gutter 3: The bulbous center portion 12*a* of the pin 1*c* towers the surface 2*a* of the pin deck 2 and thereby comes into the section of space which is scanned by the pinfall detection apparatus 10.

Because the two side walls 4 have a dark surface, as has been mentioned herein before, substantially no light is projected onto the sensor array 23 in the case that all pins 1 still stand on the pin deck 2 or in the case that there isn't any fallen pin 1*b*, 1*c* present in the region of the end of the pin deck 2. However, as soon as a fallen pin 1*b*, 1*c* is present in the region of the end of the pin deck 2, its white portions 11, 12*a* are in the scanned section 6 with the result that light is reflected and received by the pinfall detection apparatus 10. In order to process the signals present at the individual photo diodes 23*a* of the array 23 (for example, light=signal high; dark=signal low), an electronic circuit (not shown) is connected to the sensor array 23 by means of which the output signals of the photo diodes 23*a* are received and further processed and analyzed. Electronic circuits suitable for this purpose being well known to any person skilled in the art removes the need to give further explanations about their function in detail. In order to improve the reliability of the detection, one important point however, should be noted in this connection: If a great number of photo diodes 23*a*, e.g. 1028 photo diodes 23*a*, is available in the sensor array 23, a number of photo diodes 23*a* located side by side, e.g. 10 or 20 photo diodes 23*a*, must send the same output signal, e.g. a high signal, to the processing circuitry in order that it is finally decided that the corresponding pin is considered as having fallen.

It can be further seen in FIG. 6, that the white portion s of a fallen pin 1*b* projected onto the sensor array 23 by means of the optical system 21 is larger than the diameter d of the portion of the pin provided with the black ring, i.e. the foot portion 13 of a standing pin 1*a*. Thereby, it is ensured that a fallen pin 1*b* is recognized by the pinfall detection apparatus 10 in every case, even if a fallen pin lies behind a standing pin.

In order to compensate for a vertical misalignment of the pinfall detection apparatus 10 and to allow a tolerance within certain limits, the optical system 21, the sensor array 23 and/or the height and width of the black ring 14 of a pin 1 are designed such that the vertical dimension of the sensor array 23 and of a photo diode 23*a*, respectively is less than the vertical height of the picture of the black ring 14 of a pin 1 projected thereon.

In the following, and with reference to FIGS. 5 to 8, the mode of operation of the pinfall detection system and of the pin setting and resetting means shall be further explained. Thereby, only those operations of the pin setting and resetting means are discussed which are in direct connection with the present invention.

In a first example, it is assumed that the pins are arranged as shown in FIG. 3 after the first ball throw.

As soon as the thrown ball has passed a (not shown) light barrier located just in front-of the frontmost pin, the pinfall detection system scans whether or not fallen pins are present in the end region of the pin deck 2. If this is the case it is proceeded in conventional manner, i.e. the wiper member is lowered onto the pin deck 2, the still standing pins 1*a* are lifted off the pin deck 2 and the pins 1*b*, 1*c* lying on the surface 2*a* of the pin deck 2 and/or in the gutters 3 are wiped off towards the end of the pin deck 2, where they are received by the running belt conveyor 8 and transported away from the end of the pin deck. Thereafter, the lifted off pins are reset onto the pin deck 2 and the bowling lane is opened again, after the wiper member 9 has been lifted off the pin deck 2.

However, if the pinfall detection system recognizes that there isn't any fallen pin present on the pin deck 2 and/or in the gutters 3, the wiper member 9 must not be operated and can remain in the position according to FIG. 6 Moreover, it is not required to perform the set/reset cycle of the standing pins with the help of the pinsetter. In other words, neither a wiping operation nor an operation of the pinsetter has to be performed, but the game can immediately continue with the second throw of the ball.

In the case that all pins have fallen after the first throw, the process changes insofar as it is neither possible nor required to lift off any standing pins by means of the pinsetter. The pinfall detection system primarily serves for the purpose to decide whether or not a wiping operation is required.

Also in the other extreme case, i.e. if no pin at all has fallen neither after the first throw nor after the second throw, the pinsetter has not to perform unnecessarily several of the operations explained herein before.

In order to enable the pinfall detection system to recognize, if the first or the second throw of the ball has been made, the pinfall detection system can be connected to a usually already present scorer system. This is insofar advantageous as the pinsetter has to perform different operations, depending of the fact whether the first or the second ball has been thrown. Thus, such a combination presents the advantage that the operations possibly to be performed after a ball has been thrown can be optimized in the sense that any unnecessary operation of the pinsetter and/or the wiping member 9 is avoided. It is understood that it is also possible to integrate a means into the pinfall detection system which is in a position to recognize whether the first or the second ball has been thrown.

Frequently, it happens that all pins having fallen after the first throw are lying outside of the end region of the pin deck 2, because the kinetic energy transformed from the thrown ball to the pins is sufficient to move the fallen pins so far backwards that they are taken over by the running belt conveyor 8 and transported away. In this case, i.e. no fallen pin present in the end region of the pin deck, the second throw of the ball can be performed immediately, without the need to wait until a unnecessary wiping operation is performed.

Figures 9, 10:
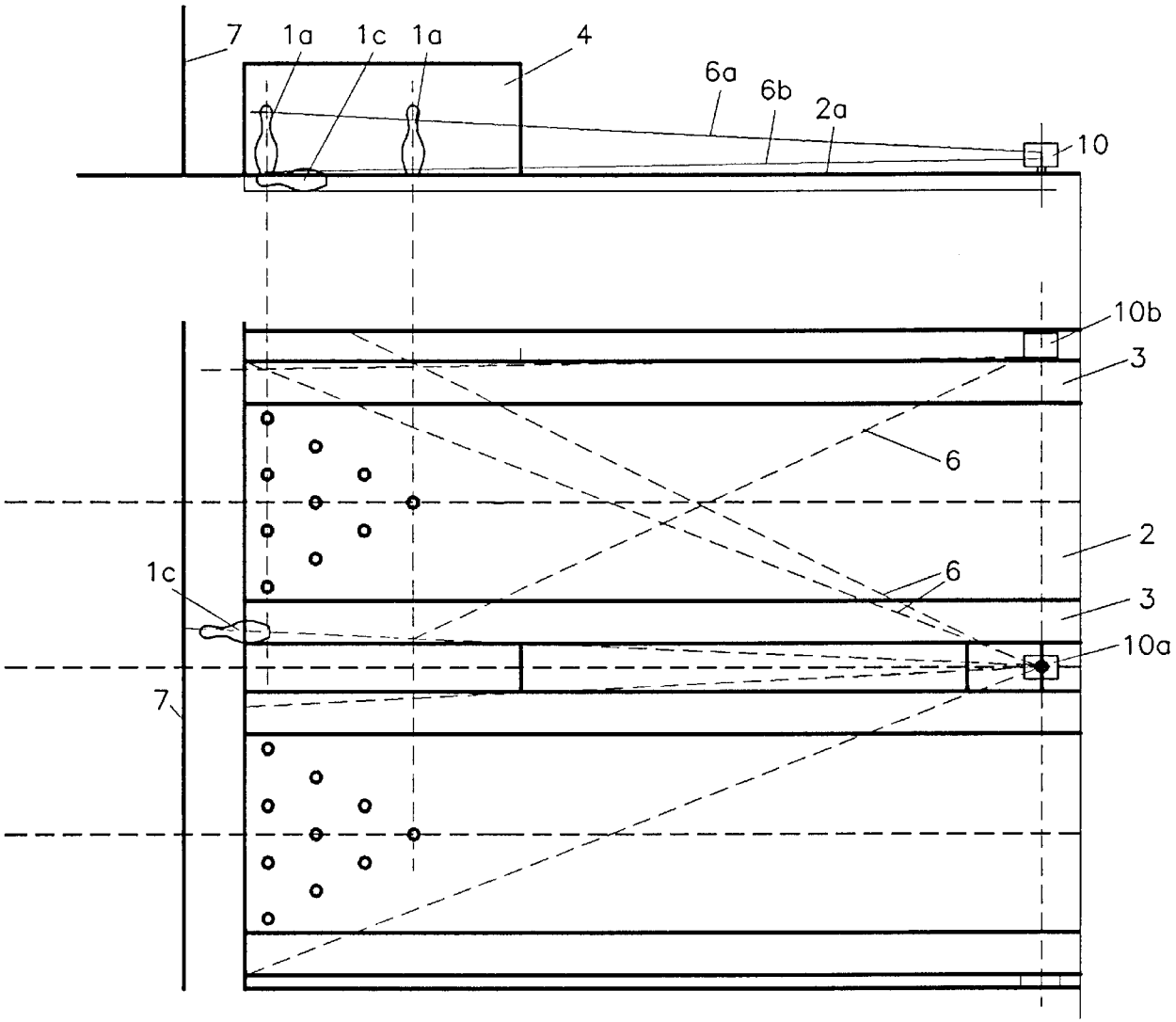
FIG. 9 shows a schematic side view of a pin deck according to an alternative embodiment with a different pinfall detection apparatus.
FIG. 10 shows a schematic top view of two adjacent pin decks according to the embodiment of FIG. 9.
Figure 11:
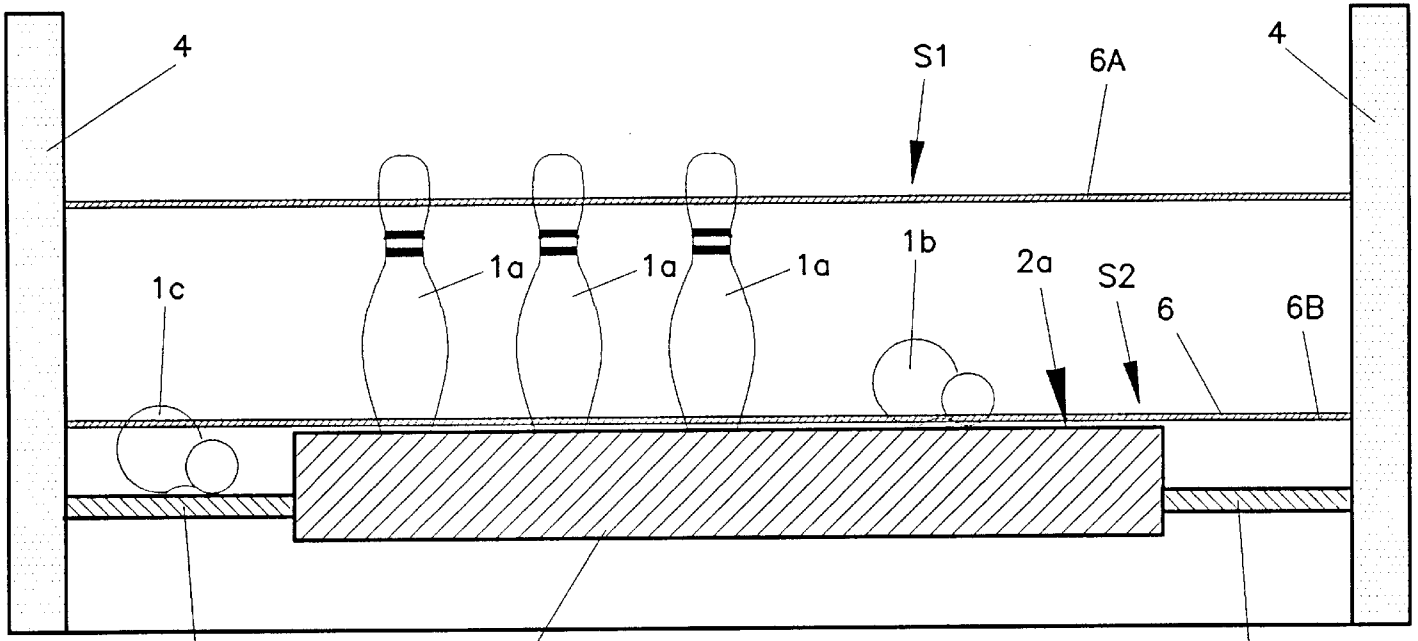
FIG. 11 shows a cross sectional view of the end region of the pin deck of FIG. 9.

FIG. 9 shows a schematic side view of a pin deck according to an alternative embodiment with a different pinfall detection apparatus, FIG. 10 shows a schematic top view of two adjacent pin decks according to the embodiment of FIG. 9, and FIG. 11 shows a cross sectional view of the end region of the pin deck of FIG. 9.

Particularly, FIG. 11 shows a cross sectional view of the end region of a pin deck according to an alternative embodiment with a different pinfall detection apparatus in which conventional pins, not having the above described black ring, can be used.

In order to explain the operation of this alternative embodiment, five pins 1 are shown in the cross sectional view of FIG. 9, all located in the end region of the bowling lane, namely three pins 1*a* standing upright on the pin deck 2, one fallen pin 1*b* lying on the pin deck 2 and one fallen pin 1*c* lying in the gutter 3.

The basic idea behind this embodiment is to provide a pinfall detection system which can also recognize standing pins. Thereby, the operation of the pinfall detection system can be as good as neutralized in the region of a standing pin, insofar as the signal reflected by the foot portion of that particular pin is not erroneously interpreted as a signal indicating a fallen pin.

For this purpose, the pinfall detection system comprises two light sensitive sensor assemblies. One of these two sensor assemblies, in the following designated as the sensor assembly S1, thereby is aligned such that in each case an upper region of a standing pin 1*a* is recognized. The region in the space that is scanned by that sensor assembly S1 is designated by reference numeral 6A in FIG. 11. One important point is that the sensor assembly S1 scans a region 6A which is located above the highest uprising portion of a pin 1*b* lying on the pin deck 2. The other sensor assembly, designated by reference numeral S2 in the following, in each case scans a lower region 6B in the space, located closely above the surface 2*a* of the pin deck 2. While the sensor assembly S1 recognizes only the radiation reflected by a standing pin 1*a*, the sensor assembly S2 recognizes not only the radiation reflected by standing pins 1*a*, but also the radiation reflected by fallen pins 1*b* lying on the surface 2*a* of the pin deck and reflected by fallen pins 1*c* lying in the gutters 3. In order to avoid dead angles, in which fallen pins cannot be detected, preferably two pinfall detection apparatuses 10*a*, 10*b* are provided, each comprising the two sensor assemblies S1, S2, and one each at every side of the bowling lane, as indicated in FIG. 10 with reference to the upper lane.

In order to enable the pinfall detection system to completely scan and recognize the end region of the bowling lane, and further in order to enable the two sensor assemblies, whose scanning directions enclose an acute angle $\alpha$ (FIG. 9), to be mounted directly one above the other one, preferably in a common housing, the pinfall detection apparatus is preferably located appr. 3 to 4 meters in front of the end region of the pin deck 2 and the position of the central pin, respectively, as can be seen in FIG. 9.

Figure 12:
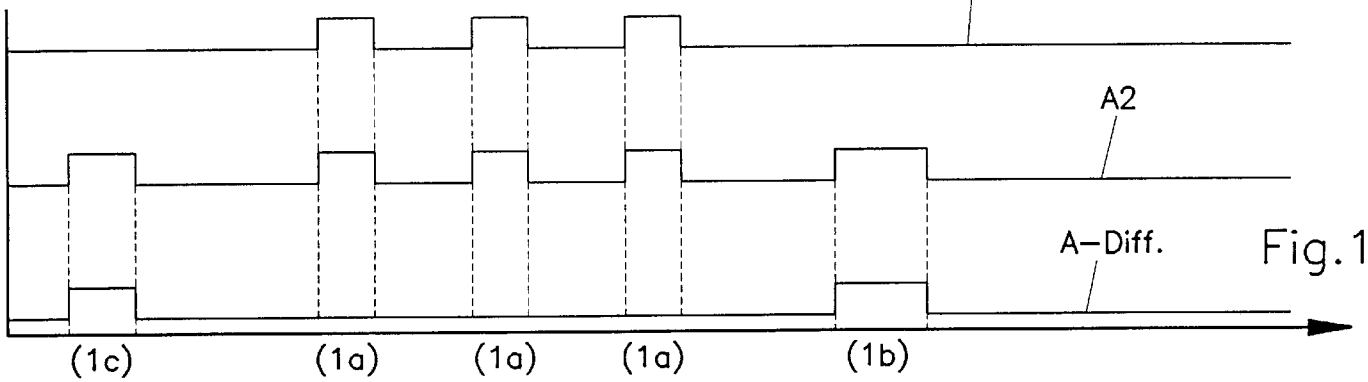
FIG. 12 shows a diagram illustrating the output signals of the pinfall detection apparatus used in the embodiment according to FIGS. 9–11.

FIG. 12 shows a extremely simplified diagram illustrating the output signals of the pinfall detection apparatus used in the alternative embodiment of FIGS. 9–11. Particularly, FIG. 12 shows the output signal A1 of the first sensor assembly S1, the output signal A2 of the second sensor assembly S2 as well as a resulting difference signal A-Diff.

One possibility to neutralize the operation of the pinfall detection system in the region of an upright standing pin 1*a* is to subtract the output signal A1 from the output signal A2. In practice, such subtraction of the signal A1 from the signal A2 can be performed both directly by the hardware used in the pinfall detection system or by the provision of a suitable software. The detection and processing of the two signals outputted by the sensor assemblies S1 and S2 is preferably realized with the help of a microprocessor which simultaneously scans the individual sensors of the corresponding sensor array of both sensor assemblies S1 and S2 in real time. Thus, it is insignificant whether or not a pin under detection has come to a rest or possibly still is somewhat rocking.

In the diagram according to FIG. 12, it can be seen that the signals generated during the scan of the head portion and the foot portion of a standing pin 1*a* cancel out one another with the result that the difference signal A-Diff. at (1*a*) is zero. Thus, a signal processing means in the pinfall detection system interprets this situation as "no pin" or "standing pin". However, in the case of a fallen pin 1*b* and 1*c*, respectively, there is a resulting difference signal A-Diff. at (1*b*) and (1*c*) in FIG. 12, because the pinfall detection apparatus cannot detect a head portion of a pin and, consequently, signal A1 at (1*c*) and (1*b*) is zero. On the other hand, the sensor assembly of the pinfall detection apparatus scanning the foot portion of the pins transmits an output signal at (1*c*) and (1*b*); thus, the resulting difference signal A-Diff. at (1*c*) and (1*b*) is different from zero- Consequently, the signal processing means in the pinfall detection system interprets this situation as "fallen pin".

It is understood that a certain tolerance must be observed as far as the impulse widths of the signals are concerned, because the width of an impulse generated upon the detection of a head portion of a standing pin must not be necessarily the same as the width of an impulse generated upon the detection of a foot portion of a standing pin.

It is quite evident from the above explanations that a plurality of operations of the wiper member and/or the pinsetter can be avoided and/or optimized in the course of a plurality of ball throws. The benefit is a greatly reduced wear of the wiper member and the pinsetter, and, additionally, any unnecessary interruption of the course of a game is avoided.

It should be mentioned here that it is basically insignificant whether or not the pinfall detection systems detects all fallen pins lying in the end region of the pin deck. Usually, it is sufficient that only one fallen pin be detected in the region of the end of the pin deck, i.e, also in the gutters, because in such a case the operation of the wiper and/or pinsetter must be initiated anyway.

Moreover, it should be mentioned that the possibilities resulting from the provision of such a pinfall detection system cannot be enumerated finally here. Many further alternatives are obvious within the scope of the present invention. For example, it is easily possible to simultaneously calculate the result of the game with the help of the sensor assembly S1 scanning the head portions of the pins.

Further, it would be possible to design the pinfall detection system according to the invention such that one pinfall detection apparatus can be used to scan two adjacent lanes.

A still further possibility would be to design the pins such that their reflection characteristics in the standing position are significantly different from the reflection characteristics in the fallen position; in this case, the pinfall detection apparatus easily could recognize whether it receives radiation from a standing or from a lying pin.

What is claimed is:

1. A photoelectric pinfall detection system to be used in a bowling alley having at least one bowling lane including two sides, said bowling lane having pins arranged in an end region thereof, and having gutter means extending along both sides of each bowling lane, said gutter means being downwardly offset in height as compared to the surface of the bowling lane, said system comprising at least one pinfall detection means adapted to recognize whether or not at least one fallen pin is lying in said end region of said bowling lane or in one of said gutter means;

said at least one pinfall detection means comprising at least a first light sensitive sensor assembly and a second light sensitive sensor assembly, both assemblies being adapted to recognize radiation reflected by the pins and to output a signal in response to the detection of radiation, said first sensor assembly comprising means to recognize the radiation reflected by an upper portion of a standing pin, and said second sensor assembly comprising means to recognize both the radiation reflected by a lower portion of a standing pin and radiation reflected by a pin lying in the end region of the bowling lane or lying in the gutter means.

2. The pinfall detection system according to claim 1, further comprising hardware and/or software means for comparing the signals outputted from said first and second sensor assemblies.

3. The pinfall detection system according to claim 2, in which said hardware and/or software means comprise means for inverting one of said output signals of said sensor assemblies and for adding said inverted output signal and the other output signal.

4. The pinfall detection system according to claim 1 in which both sides of a bowling lane are provided each with a pinfall detection means.

5. The pinfall detection system according to claim 1, said at least one pinfall detection means comprising a light sensitive sensor assembly incorporating means for detecting the radiation reflected by a pin lying in the end region of the bowling lane and the radiation reflected by a pin lying in the gutter means.

6. The pinfall detection system according to claim 5, in which said means for detecting the radiation reflected by a pin lying in the end region of the bowling lane and by a pin lying in the gutter means comprises a plurality of photo diode means arranged one besides another one in a row.

7. The pinfall detection system according to claim 6, in which said means for detecting the radiation reflected by a pin lying in the end region of the bowling lane and by a pin lying in the gutter means further comprises optical means for focusing the detected radiation on said photo diode means.

8. The pinfall detection system according to claim 6, in which an annular strip means located in said lower portion of said pins an annular strip means located in said lower portion of said pins and said side walls running along an end region and at both sides of a bowling lane are black.

9. The pinfall detection system according to claim 5, in which said optical sensor means includes means for projecting an annular strip means located in said lower portion of said pins onto said sensor assembly when a pin is in its upright standing position.

10. The pinfall detection system according to claim 9, in which a vertical dimension of said sensor assembly is less than a vertical dimension of said annular strip means projected onto said sensor assembly.

11. The pinfall detection system according to claim 5 in which each bowling lane is provided with side walls running along the end region thereof, said side walls comprising surface means having substantially the same reflective characteristics as said annular strip means located in said lower portion of said pins.

12. The pinfall detection system according to claim 5, in which said sensor assembly includes means for scanning a dimension of a portion of a fallen pin that is greater than the diameter of a pin in a region of an annular strip means.

13. The pinfall detection system according to claim 1, in which said gutter means are downwardly offset in height as compared to the surface of the bowling lane by an amount which is less than the maximum diameter of a pin.

14. The pinfall detection system according to claim 1, said pinfall detection means further comprising means for detecting the game results.

15. The pinfall detection system according to claim 14, in which said means for detecting the game results include a movable optical means and an electronically operated scorer means.

16. The pinfall detection system 14, in which said means for detecting the game results include a further sensor assembly and an electronically operated scorer means.

17. The pinfall detection system according to claim 1, in which said pinfall detection means comprises means for detecting the presence of pins standing upright in the end region of the bowling lane and creating an output signal in response thereto, whereby said output signal is not considered or electronically compensated in the particular region of a standing pin upon recognizing whether or not at least one fallen pin is lying in said end region of said bowling lane or in one of said gutter means.

18. A pin to be used in a pinfall detection system comprising surface means whose reflective characteristics, with the pin being in an upright standing position, are different from the reflective characteristics with the pin in a lying down position, said pin comprising an upper head portion, a bulbous central portion and a lower foot portion, said lower foot portion having a smaller diameter than said bulbous central portion such that said lower portion is lifted off the surface of the bowling lane when the pin is lying on said surface of the bowling lane, said pin comprising an annular strip means located in said lower portion and having reflective characteristics which are different from the reflective characteristics of said head portion and said central portion.

19. The pin according to claim 18, in which said bulbous central portion and said lower foot portion are essentially white or have a light color, said annular strip means located in said lower foot portion being essentially black.

* * * * *

UNITED STATES PATENT AND TRADEMARK OFFICE

CERTIFICATE OF CORRECTION

PATENT NO. : 5,902,188

DATED : May 11, 1999

INVENTOR(S) : Vittorio Meniconi

It is certified that error appears in the above-indentified patent and that said Letters Patent is hereby corrected as shown below:

Column 11, line 63, after "pins" delete --an annular strip means located in said lower portion of said pins--

Column 12, line 16, after "as" change "said" to --an--

Signed and Sealed this

Twenty-eighth Day of November, 2000

*Attest:*

*Attesting Officer*

Q. TODD DICKINSON

*Director of Patents and Trademarks*